US012704289B2

(12) United States Patent
Jo et al.

(10) Patent No.: US 12,704,289 B2
(45) Date of Patent: Aug. 11, 2026

(54) BLOWING APPARATUS AND AIR CONDITIONER COMPRISING SAME

(71) Applicant: Samsung Electronics Co., Ltd., Suwon-si (KR)

(72) Inventors: Eunsung Jo, Suwon-si (KR); Jaechan Park, Suwon-si (KR); Hyejeong Park, Suwon-si (KR); Jeonguk Koh, Suwon-si (KR); Moonsun Shin, Suwon-si (KR); Seungjin Yoon, Suwon-si (KR); Keunjeong Jang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 19 days.

(21) Appl. No.: 18/764,845

(22) Filed: Jul. 5, 2024

(65) Prior Publication Data

US 2024/0361035 A1 Oct. 31, 2024

Related U.S. Application Data

(63) Continuation of application No. PCT/KR2022/020451, filed on Dec. 15, 2022.

(30) Foreign Application Priority Data

Feb. 24, 2022 (KR) ..... 10-2022-0024574

(51) Int. Cl.
*F24F 13/08* (2006.01)
*F04D 29/32* (2006.01)
(Continued)

(52) U.S. Cl.
CPC ..... *F24F 13/082* (2013.01); *F04D 29/325* (2013.01); *F04D 29/522* (2013.01); *F04D 29/663* (2013.01); *F24F 13/24* (2013.01)

(58) Field of Classification Search
CPC .... F04D 29/325; F04D 29/522; F04D 29/663; F04D 29/703; F04D 19/002; F24F 13/08; F24F 13/082; F24F 13/24; F24F 1/56
(Continued)

(56) References Cited

U.S. PATENT DOCUMENTS 6,503,060 B1 1/2003 Kamada et al.
10,871,172 B2 * 12/2020 Kim ..... F04D 29/325

FOREIGN PATENT DOCUMENTS

CN 211715421 U 10/2020
EP 0905455 A1 3/1999
(Continued)

OTHER PUBLICATIONS

International Search Report for PCT/KR2022/020451 mailed Mar. 31, 2023, 5 pages.

*Primary Examiner* — Nathaniel E Wiehe
*Assistant Examiner* — Justin A Pruitt
(74) *Attorney, Agent, or Firm* — Nixon & Vanderhye P.C.

(57) ABSTRACT

A blowing apparatus according to an embodiment of the present disclosure includes: a blowing fan and a protective grille arranged in front of the blowing fan, wherein the protective grille includes: a plurality of horizontal ribs extending in a first direction and arranged in a second direction perpendicular to the first direction; and a plurality of vertical ribs extending in the second direction and arranged in the first direction to be perpendicular to the plurality of horizontal ribs, based on the blowing fan rotating, an air current moving in a third direction perpendicular to the first direction and the second direction is generated, and to correspond to a direction of rotation of the air current generated by the blowing fan, an inclination angle of each of the plurality of horizontal ribs with respect to a first plane including the first direction and the third direction changes according to a position in the first direction, and an incli-
(Continued)

nation angle of each of the plurality of vertical ribs with respect to a second plane including the second direction and the third direction changes according to a position in the second direction.

13 Claims, 12 Drawing Sheets

(51) Int. Cl.
*F04D 29/52* (2006.01)
*F04D 29/66* (2006.01)
*F24F 13/24* (2006.01)

(58) Field of Classification Search
USPC ..... 415/119
See application file for complete search history.

(56) References Cited

FOREIGN PATENT DOCUMENTS

| | | | | | |
|---|---|---|---|---|---|
| EP | 2196739 | A1 | | 6/2010 | |
| JP | 3363469 | B2 | | 8/1993 | |
| JP | H10281499 | A | | 10/1998 | |
| JP | 2003172528 | A | * | 6/2003 | |
| JP | 2006153453 | A | | 6/2006 | |
| JP | 2007163036 | A | | 6/2007 | |
| JP | 2009085562 | A | | 4/2009 | |
| JP | 4747822 | B2 | | 5/2011 | |
| KR | 100408781 | B1 | | 12/2003 | |
| KR | 100529957 | B1 | | 11/2005 | |
| KR | 20170074378 | A | | 6/2017 | |
| WO | WO-2004068039 | A1 | * | 8/2004 | ..... F04D 29/703 |

* cited by examiner

BLOWING APPARATUS AND AIR CONDITIONER COMPRISING SAME

CROSS-REFERENCE TO RELATED APPLICATIONS

This application is a continuation of International Application No. PCT/KR2022/020451 designating the United States, filed on Dec. 15, 2022, in the Korean Intellectual Property Receiving Office and claiming priority to Korean Patent Application No. 10-2022-0024574, filed on Feb. 24, 2022, in the Korean Intellectual Property Office, the disclosures of each of which are incorporated by reference herein in their entireties.

BACKGROUND

Field

The disclosure relates to a blowing apparatus and an air conditioner including the same.

Description of Related Art

In general, an air conditioner has a refrigeration cycle and may include an indoor unit arranged in an indoor space and an outdoor unit arranged in an outdoor space.

The indoor unit installed in a room sucks in indoor air, exchanges heat between the indoor air and a refrigerant, and discharges the heat-exchanged air back into the room, and the outdoor unit exchanges heat between outdoor air and the refrigerant introduced from the indoor unit to make the refrigerant capable of being heat-exchanged with indoor air again, and supplies the heat-exchanged refrigerant to the indoor unit.

The outdoor unit includes a housing and a blowing apparatus configured to generate an air current for heat exchange inside the housing. The blowing apparatus includes a blowing fan and a protective grille arranged in front of the blowing fan.

The protective grille serves to discharge a wind generated by the blowing fan to the outside, and protect the blowing fan from the outside. The protective grille has a structure in which a plurality of ribs are arranged, and may be classified as a radial structure or an orthogonal structure depending on the arrangement structure of the ribs.

The protective grille in the orthogonal structure has a shape that corresponds to the shape of the housing, and is more aesthetically pleasing than the radial structure in that the arrangement of the plurality of ribs reduces the visibility of the blowing fan to the outside. However, because the plurality of ribs are arranged at right angles in the protective grille in the orthogonal structure, the flow resistance may increase compared to the protective grille in the radial structure in a process of discharging a wind generated by the blowing fan to the outside. An increase in flow resistance may cause noise in the outdoor unit and may increase the power consumption.

SUMMARY

Embodiments of the disclosure provide a blowing apparatus including a blowing fan and a protective grille arranged in front of the blowing fan.

According an example embodiment, the protective grille may include: a plurality of horizontal ribs extending in a first direction and arranged in a second direction perpendicular to the first direction; and a plurality of vertical ribs extending in the second direction and arranged in the first direction to be perpendicular to the plurality of horizontal ribs.

When the blowing fan rotates, an air current moving in a third direction perpendicular to the first direction and the second direction may be generated.

To correspond to a direction of rotation of the air current generated by the blowing fan, an inclination angle of each of the plurality of horizontal ribs with respect to a first plane including the first direction and the third direction may change according to a position in the first direction, and an inclination angle of each of the plurality of vertical ribs with respect to a second plane including the second direction and the third direction may change according to a position in the second direction.

According to an example embodiment, an air conditioner may include: a blowing fan, a protective grille arranged in front of the blowing fan, and a housing accommodating the blowing fan.

According to an example embodiment, the protective grille may include: a plurality of horizontal ribs extending in a first direction and arranged in a second direction perpendicular to the first direction; and a plurality of vertical ribs extending in the second direction and arranged in the first direction to be perpendicular to the plurality of horizontal ribs.

When the blowing fan rotates, an air current moving in a third direction perpendicular to the first direction and the second direction may be generated, and to correspond to a direction of rotation of the air current generated by the blowing fan, an inclination angle of each of the plurality of horizontal ribs with respect to a first plane including the first direction and the third direction may change according to a position in the first direction, and an inclination angle of each of the plurality of vertical ribs with respect to a second plane including the second direction and the third direction may change according to a position in the second direction.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
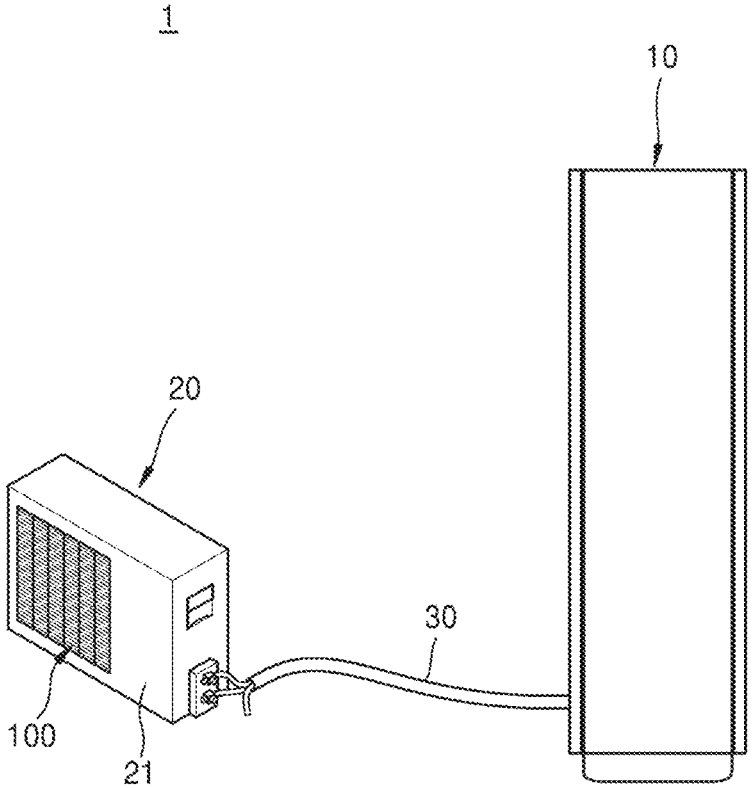
FIG. 1 is a perspective view illustrating an example air conditioner according to various embodiments.

Hereinafter, various example embodiments of the present disclosure will be described in greater detail with reference to the accompanying drawings. Like reference numerals in the drawings indicate parts or elements that perform substantially the same functions.

Terms such as "first" or "second" may be used to describe various elements, but the elements are not limited by the terms. These terms are simply used to distinguish one element from another element. For example, a first element may be referred to as a second element, and a second element may be referred to as a first element in a similar manner, without departing from the scope of the present disclosure. The term "and/or" includes any and all combinations of one or more of the associated listed items.

Terms used herein are for describing various embodiments and are not intended to limit the scope of the present disclosure. Singular forms are intended to include plural forms as well, unless the context clearly indicates otherwise. In the present disclosure, it is to be understood that the terms such as "including," "having," and "comprising" are intended to indicate the existence of the features, numbers, steps, actions, components, parts, or combinations thereof that are disclosed, and are not intended to preclude the possibility that one or more other features, numbers, steps, actions, components, parts, or combinations thereof may exist or may be added. Like reference numerals in the drawings indicate members that perform substantially the same functions.

Figure 2:
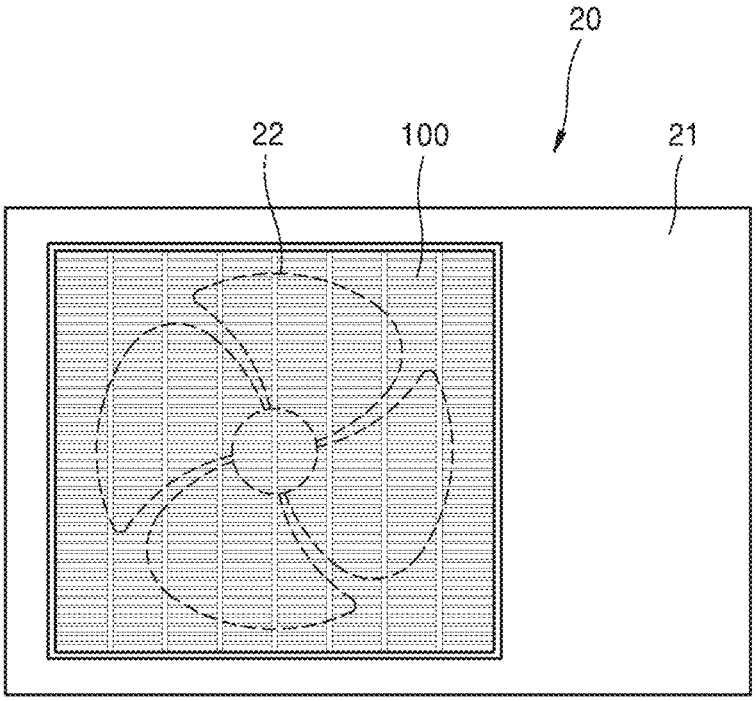
FIG. 2 is a diagram illustrating a front view illustrating an outdoor unit of FIG. 1 according to various embodiments.
Figure 3:
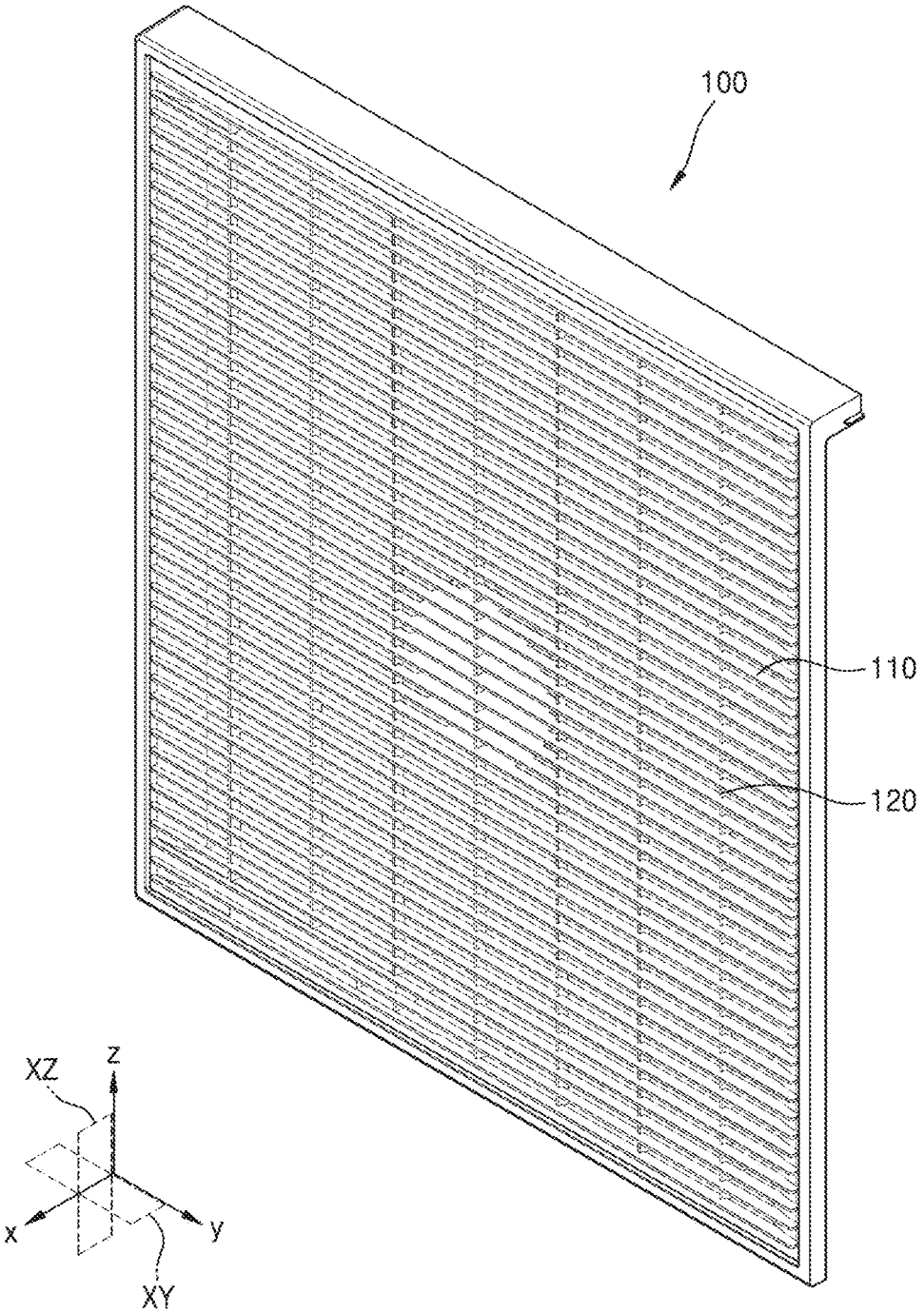
FIG. 3 is a perspective view illustrating a protective grille of FIG. 2 according to various embodiments.

FIG. 1 is a perspective view illustrating an example air conditioner 1 according to various embodiments, FIG. 2 is a diagram illustrating a front view illustrating an outdoor unit 20 of FIG. 1 according to various embodiments, and FIG. 3 is a perspective view illustrating an example protective grille 100 of FIG. 2 according to various embodiments.

Referring to FIGS. 1 and 2, the air conditioner 1 according to an embodiment includes an indoor unit 10 arranged in an indoor space, and the outdoor unit 20 arranged in an outdoor space. The indoor unit 10 and the indoor unit 10 may be connected to each other through a refrigerant pipe 30 that delivers a refrigerant.

The indoor unit 10 may include an indoor heat exchanger (not shown) configured to exchange heat with indoor air, an indoor blowing fan (not shown) to suck in and blow indoor air such that the indoor air passes through the indoor heat exchanger, and an expansion valve (not shown) to depressurize and expand the refrigerant.

The outdoor unit 20 includes an outdoor heat exchanger (not shown) configured to exchange heat with outdoor air, a blowing fan 22 to suck in and blow outdoor air such that the outdoor air passes through the outdoor heat exchanger, a compressor (not shown) configured to compress a refrigerant, and a housing 21 accommodating therein the outdoor heat exchanger, the blowing fan 22, and the compressor.

The housing 21 may have an overall rectangular parallelepiped structure, and the protective grille 100 may be installed on one surface of the housing 21 to be located in front of the blowing fan 22. In an embodiment, the outdoor unit 20 is described as an example of the blowing apparatus, however, it is needless to say that the blowing device may be modified in various ways as long as an air current is generated by the blowing fan 22 and the blowing fan 22 is protected by the protective grille 100.

Referring to FIGS. 2 and 3, the protective grille 100 according to an embodiment may have an orthogonal grille structure. The protective grille 100 includes a plurality of horizontal ribs 110 and a plurality of vertical ribs 120 arranged to be perpendicular to each other.

Each of the plurality of horizontal ribs 110 extends in a first direction y and is arranged in a second direction z that is perpendicular to the first direction y. For example, the plurality of horizontal ribs 110 may have the same shape. For example, although not illustrated, at least some of the plurality of horizontal ribs 110 may have different shapes.

The plurality of horizontal ribs 110 may have a certain thickness or greater to ensure a certain strength. For example, each of the plurality of horizontal ribs 110 may have a thickness of 10 mm or greater in a third direction x that is perpendicular to the first direction y and the second direction z. The plurality of horizontal ribs 110 may have a thickness of 500 mm or less in the third direction x.

Each of the plurality of vertical ribs 120 extends in the second direction z so as to be perpendicular to the plurality of horizontal ribs 110, and is arranged in the first direction y. For example, the plurality of vertical ribs 120 may have the same shape. As another example, although not illustrated, at least some of the plurality of vertical ribs 120 may have different shapes.

The plurality of vertical ribs 120 may have a certain thickness or greater to ensure a certain strength. For example, each of the plurality of vertical ribs 120 may have a thickness of 10 mm or greater in the third direction x. The plurality of vertical ribs 120 may have a thickness of 500 mm or less in the third direction x.

A spacing between the plurality of horizontal ribs 110 may be smaller than a spacing between the plurality of vertical ribs 120. For example, the spacing between the plurality of horizontal ribs 110 may be less than half the spacing between the plurality of vertical ribs 120.

The outer shape of the protective grille 100 may be different from the outer shape of the blowing fan 22 arranged at the rear thereof. For example, in a case in which the outer shape of the blowing fan 22 is circular, the outer shape of the protective grille 100 may be quadrangular, unlike the blowing fan 22. The outer shape of the protective grille 100 may correspond to the outer shape of the housing 21. By matching the outer shapes of the protective grille 100 and the housing 21, the aesthetics of the outdoor unit 20 may be improved.

In the protective grille 100, regardless of the outer shape of the blowing fan 22, the plurality of horizontal ribs 110 extend in the first direction y, and the plurality of vertical ribs 120 extend in the second direction z. In addition, the plurality of horizontal ribs 110 may be arranged with a narrow spacing therebetween. Accordingly, the protective grille 100 may protect the blowing fan 22 arranged at the rear thereof from the outside, and reduce the visibility of the rotation of the blowing fan 22 from the outside.

Figure 4:
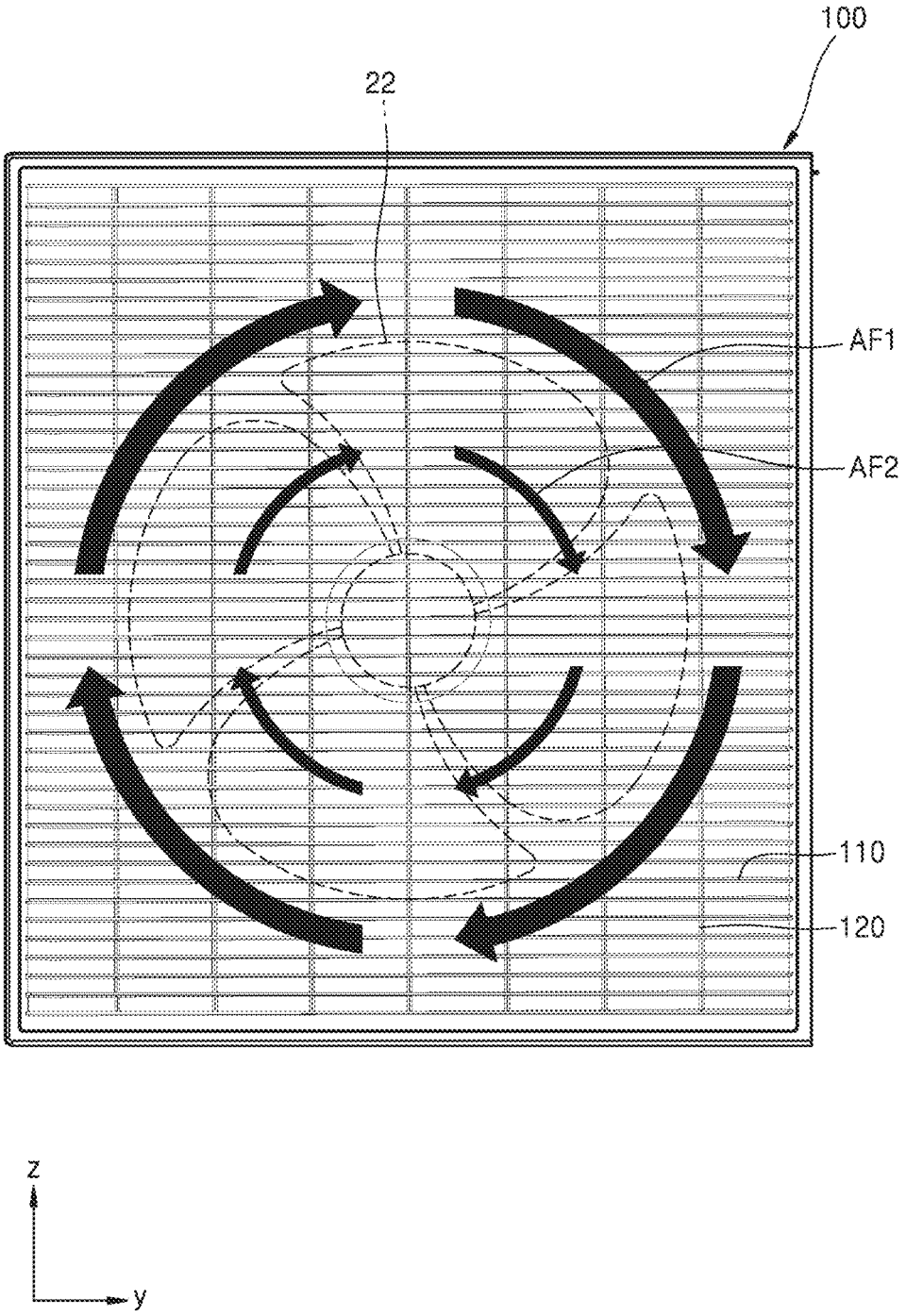
FIG. 4 is a diagram illustrating example directions of air currents in a protective grille, according to various embodiments.
Figure 5:
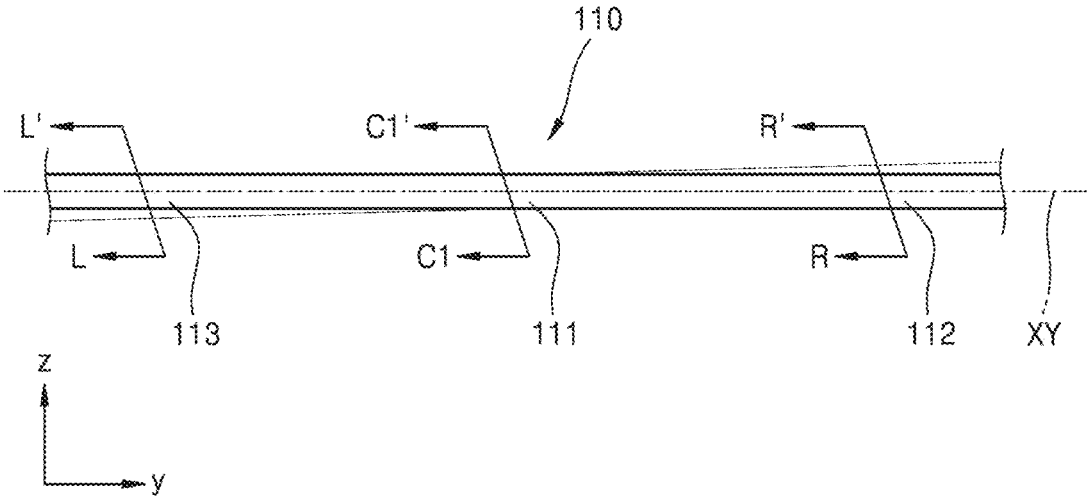
FIG. 5 is a diagram illustrating a front view for describing a horizontal rib of the protective grille illustrated in FIG. 3 according to various embodiments.

FIG. 4 is a diagram illustrating example directions of air currents AF1 and AF2 in the protective grille 100, according to various embodiments. FIG. 5 is a diagram illustrating a front view for describing the horizontal rib 110 of the protective grille 100 illustrated in FIG. 3 according to various embodiments.

Referring to FIG. 4, the air currents AF1 and AF2 generated by the blowing fan 22 move in the third direction x, and have a rotation direction due to the rotation of the blowing fan 22. The air currents AF1 and AF2 generated by the blowing fan 22 may increase in velocity in the radial direction from the center of rotation, and thus spread outward in the radial direction with a spiral structure. For example, the velocity of the air current AF1 passing through an area far from the center of rotation of the blowing fan 22 may be greater than the velocity of the air current AF2 passing through an area close to the center of rotation of the blowing fan 22.

Because the protective grille 100 has an orthogonal structure that does not match the directions of the air currents AF1 and AF2 generated by the blowing fan 22, the arrangement of the plurality of horizontal ribs 110 and the plurality of vertical ribs 120 may act as flow resistance to the air currents AF1 and AF2 generated by the blowing fan 22. The protective grille 100 according to an embodiment provides the plurality of horizontal ribs 110 and the plurality of vertical ribs 120 having structures capable of reducing flow resistance considering the directions of the air currents AF1 and AF2 generated by the blowing fan 22.

Referring to FIGS. 3 and 5, the inclination angle of each of the plurality of horizontal ribs 110 with respect to a first plane XY including the first direction y and the third direction x may change according to the position in the first direction y, to correspond to the directions of rotation of the air currents AF1 and AF2 generated by the blowing fan 22. Here, the inclination angle of the horizontal rib 110 with respect to the first plane XY may be defined as the angle at which the horizontal rib 110 is inclined in the second direction z with respect to the first plane XY. For example, the inclination angle of the horizontal rib 110 with respect to the first plane XY may be defined as the angle at which the cross-sectional shape of the horizontal rib 110 taken along a second plane XZ is inclined with respect to the first plane XY.

The horizontal rib 110 includes a center area 111 overlapping the center of rotation of the blowing fan 22, a right area 112 extending to the right from the center area 111, and a left area 113 extending to the left from the center area 111, according to their positions in the first direction y.

Figure 6A:
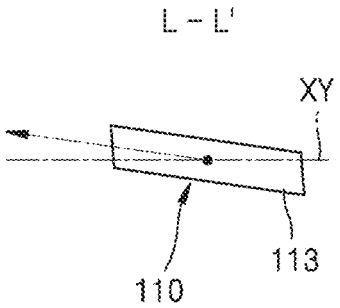
FIGS. 6A, 6B and 6C are a cross-sectional views of the horizontal rib of FIG. 5 according to various embodiments.
Figure 6B:
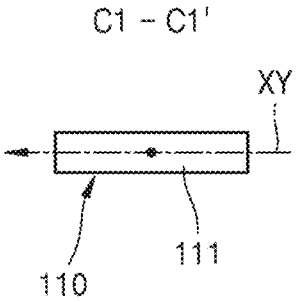
Figure 6C:
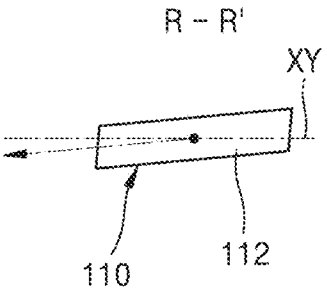

FIGS. 6A, 6B and 6C are cross-sectional views of the horizontal rib 110 of FIG. 5 according to various embodiments. In FIG. 6, directions of inclination of the horizontal rib 110 with respect to the first plane XY are indicated by arrows.

Referring to FIG. 5 and (FIG. 6B, the inclination angle of the center area 111 of the horizontal rib 110 with respect to the first plane XY may be about 0 degrees. Referring to FIG. 5, and FIGS. 6A and 6C, the left area 113 and the right area 112 of the horizontal rib 110 may have inclination angles in opposite directions. For example, the left area 113 of the horizontal rib 110 may have an upward inclination angle with respect to the first plane XY, which is inclined in an upward direction with respect to the first plane XY. The right area 112 of the horizontal rib 110 may have a downward inclination angle with respect to the first plane XY, which is inclined in a downward direction with respect to the first plane XY. It may be described that, when a downward inclination angle with respect to the first plane XY is defined as a positive (+) angle, the inclination angle of the right area 112 has a positive (+) angle with respect to the first plane XY, and the inclination angle of the left area 113 has a negative (−) angle with respect to the first plane XY. Here, the definition as to whether an inclination angle is a positive (+) angle or a negative (−) angle is only for consistent expression in the description to be provided below, and it is needless to say that positivity and negativity may be defined otherwise depending on the definition.

In the right area 112, the inclination angle with respect to the first plane XY may increase toward the right, and in the left area 113, the inclination angle with respect to the first plane XY may decrease toward the left. The inclination angle of the horizontal rib 110 may continuously change in the first direction y. For example, the inclination angle of the horizontal rib 110 may linearly change in the first direction y.

The amount of change in the inclination angle of the horizontal rib 110 from the center to an end in the first direction y may be within a predetermined (e.g., specified) angle range. For example, the amount of change in the inclination angle of the horizontal rib 110 from the center to an end may be 45 degrees or less. For example, the amount of change in the inclination angle of the horizontal rib 110 from the center to an end may be 30 degrees or less. For example, the amount of change in the inclination angle of the horizontal rib 110 from the center to an end may be 15 degrees or less.

The horizontal rib 110 may have a twisted shape such that the inclination angle thereof with respect to the first plane XY changes, according to the position in the first direction y. The horizontal rib 110 may have a twisted shape based on an end thereof in the third direction x (see FIG. 3). For example, the horizontal rib 110 may have a twisted shape based on an end through which an air current is discharged, or an end through which an air current is sucked in. For example, in a structure in which the horizontal rib 110 has a twisted shape based on the end through which an air current is discharged, the end of the horizontal rib 110 through which an air current is discharged may have a straight structure extending in the first direction y, whereas the end through which an air current is sucked in may be twisted and thus have a curved structure inclined with respect to the first direction y. As another example, in a structure in which the horizontal rib 110 has a twisted shape based on the end through which an air current is sucked in, the end of the horizontal rib 110 through which an air current is sucked in may have a straight structure extending in the first direction y, whereas the end through which an air current is discharged may be twisted and thus have a curved structure inclined with respect to the first direction y. However, the twisted shape of the horizontal rib 110 is not limited thereto, and may have a twisted shape based on the center of the horizontal rib 110 in the first direction y and the front-rear direction x.

The plurality of horizontal ribs 110 may have the same shape. For example, the plurality of horizontal ribs 110 may have the same change in inclination angle in the first direction y. Thus, portions of the plurality of horizontal ribs 110 at the same position in the first direction y may have the same inclination angle. As such, the plurality of horizontal ribs 110 are designed to have the same shape, and thus, the protective grille 100 may be easily manufactured.

However, the structure of the plurality of horizontal ribs 110 is not limited thereto, and may have different shapes as needed. For example, although not illustrated, the plurality of horizontal ribs 110 may have different inclination angles in the first direction y to be optimized for changes in the velocities of the air currents AF1 and AF2.

Figure 7:
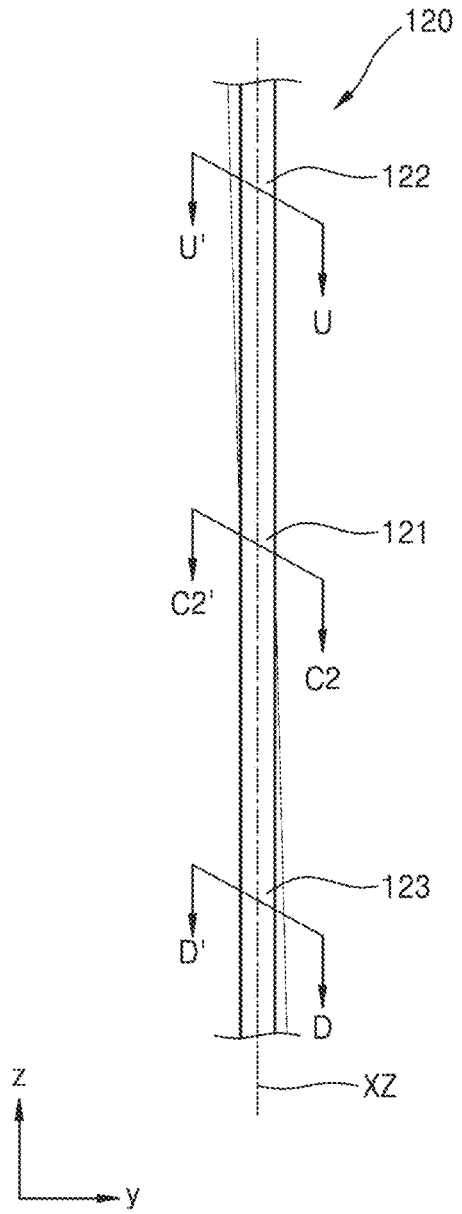
FIG. 7 is a diagram illustrating a front view of an example vertical rib of the protective grille illustrated in FIG. 3 according to various embodiments.

FIG. 7 is a diagram illustrating a front view of the vertical rib 120 of the protective grille 100 illustrated in FIG. 3 according to various embodiments.

Referring to FIGS. 3 and 7, the inclination angle of the vertical rib 120 with respect to the second plane XZ including the second direction z and the third direction x may change according to the position in the second direction z, to correspond to the directions of rotation of the air currents AF1 and AF2 generated by the blowing fan 22. Here, the inclination angle of the vertical rib 120 with respect to the second plane XZ may be defined as the angle at which the vertical rib 120 is inclined in the first direction y with respect to the second plane XZ. For example, the inclination angle of the vertical rib 120 with respect to the second plane XZ may be defined as the angle at which the cross-sectional shape of the vertical rib 120 taken along the first plane XY is inclined with respect to the second plane XZ.

The vertical rib 120 includes a center area 121 overlapping the center of rotation of the blowing fan 22, an upper area 122 extending upward from the center area 121, and a lower area 123 extending downward from the center area 121, according to their positions in the second direction z.

Figure 8A:
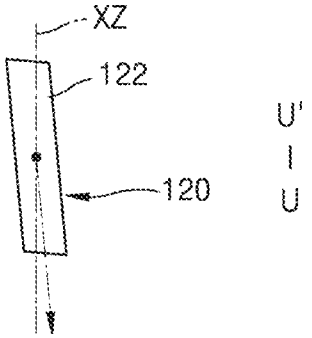
FIGS. 8A, 8B and 8C are cross-sectional views of the vertical rib of FIG. 7 according to various embodiments.
Figure 8B:
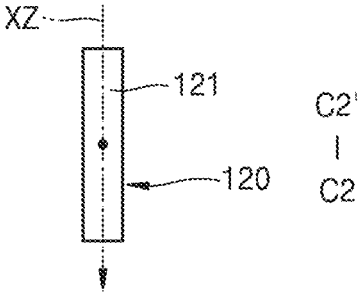
Figure 8C:
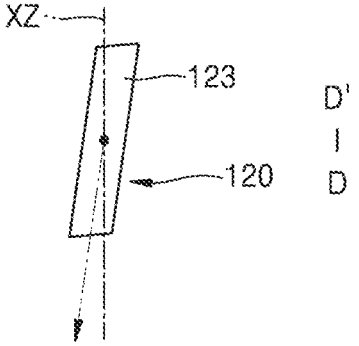

FIGS. 8A, 8B and 8C are cross-sectional views of the vertical rib 120 of FIG. 7. In FIG. 8, directions of inclination of the vertical rib 120 with respect to the second plane XZ are indicated by arrows according to various embodiments.

Referring to FIG. 7 and FIG. 8B, the inclination angle of the center area 121 of the vertical rib 120 with respect to the second plane XZ may be about 0 degrees. Referring to FIG. 7, and FIGS. 8A and 8C, the upper area 122 and the lower area 123 of the vertical rib 120 may have inclination angles in opposite directions. For example, the upper area 122 of the vertical rib 120 may have a rightward inclination angle with respect to the second plane XZ, which is inclined in a rightward direction with respect to the second plane XZ. The lower area 123 of the vertical rib 120 may have a leftward inclination angle with respect to the second plane XZ, which is inclined in a leftward direction with respect to the second plane XZ. It may be described that, when a rightward inclination angle with respect to the second plane XZ is defined as a positive (+) angle, the inclination angle of the upper area 122 has a positive (+) angle with respect to the second plane XZ, and the inclination angle of the lower area 123 has a negative (−) angle with respect to the second plane XZ. Here, the definition as to whether an inclination angle is a positive (+) angle or a negative (−) angle is only for consistent expression in the description to be provided below, and it is needless to say that positivity and negativity may be defined otherwise depending on the definition.

In the upper area 122, the inclination angle with respect to the second plane XZ may increase toward the top, and in the lower area 123, the inclination angle with respect to the second plane XZ may decrease toward the bottom. The inclination angle of the vertical rib 120 may continuously change in the second direction z. For example, the inclination angle of the vertical rib 120 may linearly change in the second direction z.

The amount of change in the inclination angle of the vertical rib 120 from the center to an end in the second direction z may be within a predetermined angle range. For example, the amount of change in the inclination angle of the vertical rib 120 from the center to an end may be 45 degrees or less. For example, the amount of change in the inclination angle of the vertical rib 120 from the center to an end may be 30 degrees or less. For example, the amount of change in the inclination angle of the vertical rib 120 from the center to an end may be 15 degrees or less.

The vertical rib 120 may have a twisted shape such that the inclination angle thereof with respect to the second direction z changes, according to the position in the second direction z. The vertical rib 120 may have a twisted shape based on an end thereof in the third direction x (see FIG. 3). For example, the vertical rib 120 may have a twisted shape based on an end through which an air current is discharged, or an end through which an air current is sucked in. For example, in a structure in which the vertical rib 120 has a twisted shape based on the end through which an air current is discharged, the end of the vertical rib 120 through which an air current is discharged may have a straight structure extending in the second direction z, whereas the end through which an air current is sucked in may be twisted and thus have a curved structure inclined with respect to the second direction z. As another example, in a structure in which the vertical rib 120 has a twisted shape based on the end through which an air current is sucked in, the end of the vertical rib 120 through which an air current is sucked in may have a straight structure extending in the second direction z, whereas the end through which an air current is discharged may be twisted and thus have a curved structure inclined with respect to the second direction z. However, the twisted shape of the vertical rib 120 is not limited thereto, and may have a twisted shape based on the center of the vertical rib 120 in the second direction z and the front-rear direction x.

The plurality of vertical ribs 120 may have the same shape. For example, the plurality of vertical ribs 120 may have the same change in inclination angle in the second direction z. Thus, portions of the plurality of vertical ribs 120 at the same position in the second direction z may have the same inclination angle. As such, the plurality of vertical ribs 120 are designed to have the same shape, and thus, the protective grille 100 may be easily manufactured.

However, the structure of the plurality of vertical ribs 120 is not limited thereto, and may have different shapes as needed. For example, although not illustrated, the plurality of vertical ribs 120 may have different inclination angles in second direction z to be optimized for changes in the velocities of the air currents AF1 and AF2.

As described above, as the inclination angles of the horizontal ribs 110 and the vertical ribs 120 in the protective grille 100 according to an embodiment change from the center to an end, the flow resistance of the air currents AF1 and AF2 generated by the blowing fan 22 may be reduced.

Figure 9:
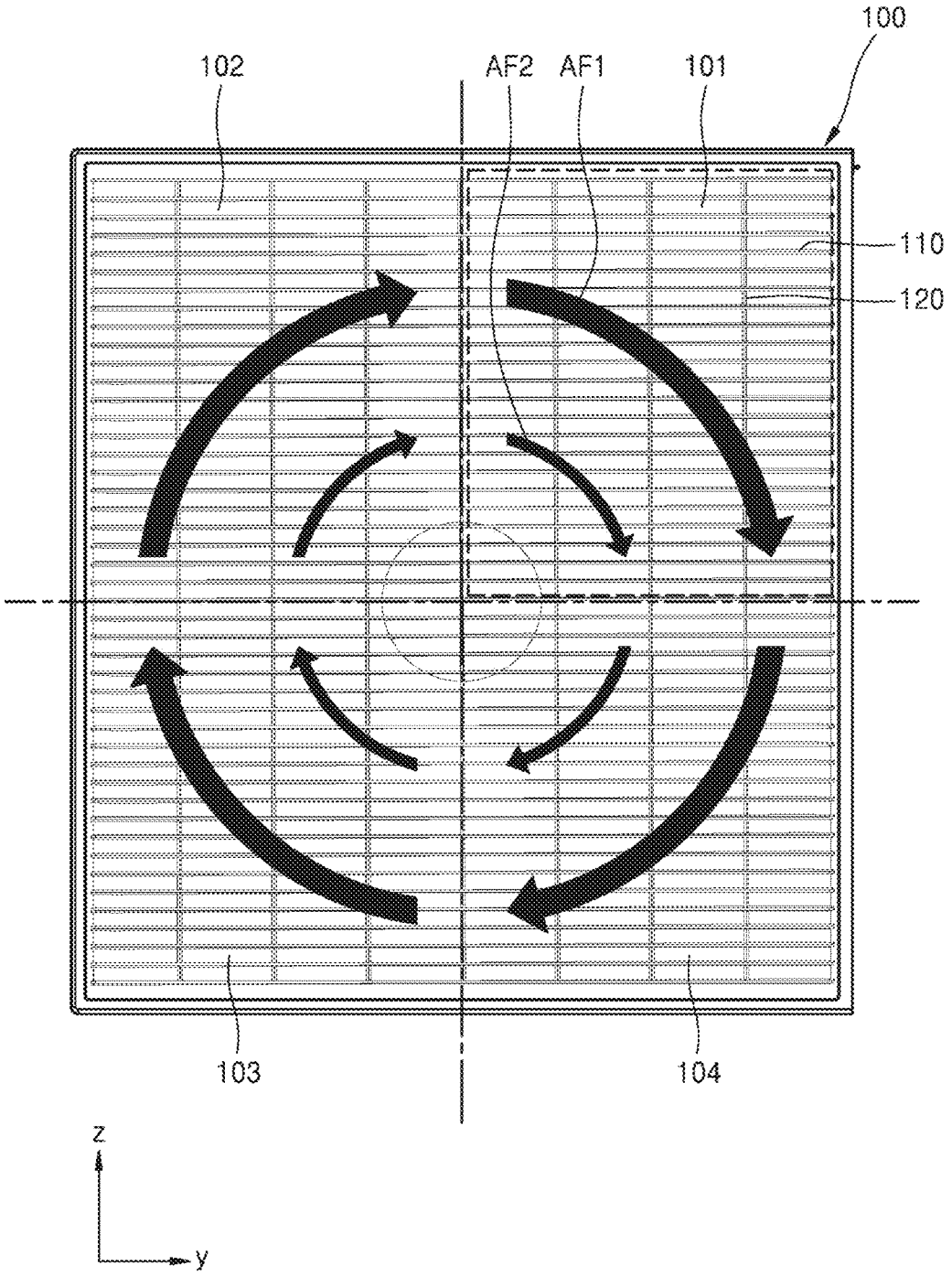
FIG. 9 is a illustrating an example relationship between the shape of a protective grille and the direction of an air current, according to various embodiments.

Referring to FIG. 9, when the protective grille 100 is divided into four quadrants by virtual axes in the first direction y and the second direction z with respect to the center of rotation of the blowing fan 22, the combinations of inclination angles of the horizontal ribs 110 and the vertical ribs 120 arranged in the respective quadrants may be different from each other. For example, in a first quadrant 101 of the protective grille 100, the horizontal rib 110 may have a positive (+) inclination angle with respect to the first plane XY, which is inclined in a downward direction with respect to the first plane XY, and the vertical rib 120 may have a positive (+) inclination angle with respect to the second plane XZ, which is inclined in a rightward direction with respect to the second plane XZ. In a second quadrant 102 of the protective grille 100, the horizontal rib 110 may have a negative (−) inclination angle with respect to the first plane XY, which is inclined in an upward direction with respect to the first plane XY, and the vertical rib 120 may have a positive (+) inclination angle with respect to the second plane XZ, which is inclined in a rightward direction with respect to the second plane XZ. In a third quadrant 103 of the protective grille 100, the horizontal rib 110 may have a negative (−) inclination angle with respect to the first plane XY, which is inclined in an upward direction with respect to the first plane XY, and the vertical rib 120 may have a negative (−) inclination angle with respect to the second plane XZ, which is inclined in a leftward direction with respect to the second plane XZ. In a fourth quadrant 104 of the protective grille 100, the horizontal rib 110 may have a positive (−) inclination angle with respect to the first plane XY, which is inclined in a downward direction with respect to the first plane XY, and the vertical rib 120 may have a negative (−) inclination angle with respect to the second plane XZ, which is inclined in a leftward direction with respect to the second plane XZ.

As such, in the protective grille 100 according to an embodiment, by a structure with different combinations of the inclination angles of the horizontal ribs 110 and the vertical ribs 120 according to the positions of the quadrants, it is possible to reduce the flow resistance of the protective grille 100 against the air currents AF1 and AF2 generated by the blowing fan 22, without complex structural design.

The effect of the protective grille 100, the air currents AF1 and AF2 that are generated by the blowing fan 22 and then pass through the protective grille 100 will be described. For convenience of description, descriptions will focus on the rotational force among the forces acting on the air currents AF1 and AF2.

The air currents AF1 and AF2 generated by the blowing fan 22 move in different directions in the respective quadrants of the protective grille 100. For example, when the directions of rotation of the air currents AF1 and AF2 passing through the protective grille 100 are clockwise, the air currents AF1 and AF2 generally move downward to the right in the first quadrant 101, downward to the left in the fourth quadrant 104, upward to the left in the third quadrant 103, and upward to the right in the second quadrant 102.

The directions of the air currents AF1 and AF2 passing through the first quadrant 101 of the protective grille 100 change from the rightward direction to the downward direction. The velocities of the air currents AF1 and AF2 passing through the first quadrant 101 increase as the distance from the center of rotation of the blowing fan 22 increases. The directions of the air currents AF1 and AF2 passing through the fourth quadrant 104 of the protective grille 100 change from the downward direction to the leftward direction. The velocities of the air currents AF1 and AF2 passing through the fourth quadrant 104 increase as the distance from the center of rotation of the blowing fan 22 increases. The directions of the air currents AF1 and AF2 passing through the third quadrant 103 of the protective grille 100 change from the leftward direction to the upward direction. The velocities of the air currents AF1 and AF2 passing through the third quadrant 103 increase as the distance from the center of rotation of the blowing fan 22 increases. The directions of the air currents AF1 and AF2 passing through the second quadrant 102 of the protective grille 100 change from the upward direction to the rightward direction. The velocities of the air currents AF1 and AF2 passing through the second quadrant 102 increase as the distance from the center of rotation of the blowing fan 22 increases.

As described above, in the protective grille 100 according to an embodiment, the combinations of the inclination angles of the vertical ribs 120 and the horizontal ribs 110 located in the quadrants are different from each other, thus, it is possible to respond to changes in the directions and velocities of the air currents AF1 and AF2 passing through the respective quadrants of the protective grille 100, and accordingly, the flow resistance of the protective grille 100 may be reduced.

Figure 10:
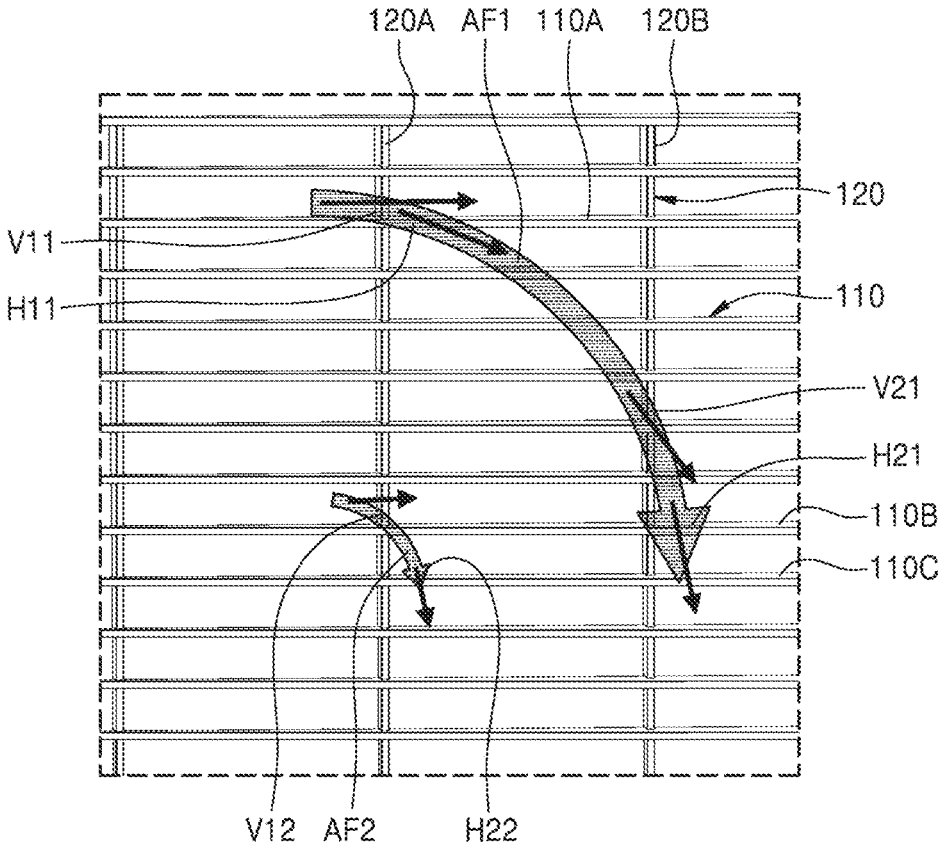
FIG. 10 is an enlarged view of a portion of a first quadrant of FIG. 9 according to various embodiments.

Referring to FIG. 10, the air currents AF1 and AF2 passing through the first quadrant 101 of the protective grille 100 rotate while moving in an overall downward direction to the right. The air currents AF1 and AF2 passing through the first quadrant 101 of the protective grille 100 may include an air current AF1 rotating far from the center of rotation of the blowing fan 22. For example, the air current AF1 may be a rotating air current AF1 passing through a first point V11, a second point H11, a third point V21, and a fourth point H21 in the first quadrant 101.

In the first point V11 arranged in a relatively upper portion of the first quadrant 101 of the protective grille 100, the air current AF1 may move substantially parallel to the rightward direction. A portion of a first vertical rib 120A arranged at the first point V11 is close to an end of the first vertical rib 120A in the second direction z, and thus has a relatively high inclination angle with respect to the second plane XZ. Accordingly, the portion of the first vertical rib 120A arranged at the first point V11 and having a high inclination angle with respect to the second plane XZ may enable the air current AF1 moving substantially parallel to the rightward direction, to pass through the protective grille 100 without significant flow resistance.

The direction of the air current AF1 passing through the first quadrant 101 gradually changes from the rightward direction to the downward direction. In this process, the air current AF1 may pass through the second point H11. The air current AF1 may pass through a first horizontal rib 110A arranged at the second point H11. A portion of the first horizontal rib 110A arranged at the second point H11 is between the center and an end of the first horizontal rib 110A in the first direction y, and thus may not have a high inclination angle with respect to the first plane XY. However, the rightward force acting on the air current AF1 passing through the second point H11 is stronger than the downward force acting on the air current AF1. Thus, even when the inclination angle of the portion of the first horizontal rib 110A with respect to the second plane XZ is not high, the flow resistance to the air current AF1 is not high.

The air current AF1 passing through the first quadrant 101 may pass through the third point V21. The air current AF1 may pass through a portion of a second vertical rib 120B arranged at the third point V21. The portion of the second vertical rib 120B arranged at the third point V21 is between the center and an end of the second vertical rib 120B in the second direction z, and thus may have not a high inclination angle with respect to the second plane XZ. However, the downward force acting on the air current AF1 passing through the third point V21 is stronger than the rightward force acting on the air current AF1. Thus, even when the inclination angle of the portion of the second vertical rib 120B with respect to the second plane XZ is not high, the flow resistance to the air current AF1 is not high.

The air current AF1 passing through the first quadrant 101 may pass through the fourth point H21. The air current AF1 passing through the fourth point H21 may move substantially parallel to the downward direction. The air current AF1 may pass through a portion of a second horizontal rib 110B arranged at the fourth point H21. The portion of the second inclination rib 110B arranged at the fourth point H21 is adjacent to an end of the second horizontal rib 110B in the first direction y, and thus may have a high inclination angle with respect to the first plane XY. Accordingly, the portion of the second horizontal rib 110B arranged at the fourth point H21 and having a high inclination angle with respect to the first plane XY may enable the air current AF1 moving substantially parallel to the downward direction, to pass through the protective grille 100 without significant flow resistance.

In addition, a portion of the air currents AF1 and AF2 passing through the first quadrant 101 of the protective grille 100 may be an air current AF2 rotating close to the center of rotation of the blowing fan 22. For example, the air current AF2 may be a rotating air current AF2 passing through a fifth point V12 and a sixth point H22 in the first quadrant 101.

The air current AF2 passing through the fifth point V12 may move substantially parallel to the rightward direction. A portion of the first vertical rib 120A arranged at the fifth point V12 is close to the center of the first vertical rib 120A in the second direction z, and thus, the inclination angle of the portion of the first vertical rib 120A with respect to the second plane XZ may be relatively low compared to the inclination angle of a portion of the first vertical rib 120A close to an outer edge of the first vertical rib 120A in the second direction z. Considering the direction of the air current AF2 passing through the fifth point V12, the inclination angle of the portion of the first vertical rib 120A arranged at the fifth point V12 may be low. However, because the velocity of the air current AF2 passing through the fifth point V12 is less than the velocity of the air current AF1 passing through the first point V11, the portion of the first vertical rib 120A arranged at the fifth point V12 may enable the air current AF2 to pass through the protective grille 100 without significant flow resistance.

The air current AF2 passing through the sixth point H22 may move substantially parallel to the downward direction. A portion of a third horizontal rib 110C arranged at the sixth point H22 is close to the center of the third horizontal rib 110C in the first direction y, and thus, the inclination angle of the portion of the third horizontal rib 110C with respect to the first plane XY may be relatively low compared to the inclination angle of a portion of the third horizontal rib 110C close to an outer edge of the third horizontal rib 110C in the first direction y. Relative to the angle of the air current AF2 passing through the sixth point H22, the inclination angle of the portion of the third horizontal rib 110C arranged at the sixth point H22 may be low. However, because the velocity of the air current AF2 passing through the sixth point H22 is less than the velocity of the air current AF1 passing through the fourth point H21, the portion of the third horizontal rib 110C arranged at the sixth point H22 may enable the air current AF2 to pass through the protective grille 100 without significant flow resistance.

As such, in the protective grille 100 according to an embodiment, through a structure in which the inclination angles of the plurality of horizontal ribs 110 and the plurality of vertical ribs 120 change from the center to an end, it is possible to increase the inclination angle of a portion of the horizontal rib 110 or the vertical rib 120 where flow friction may be relatively large due to the velocities or directions of the air currents AF1 and AF2, and decrease the inclination angle of a portion of the horizontal rib 110 or the vertical rib 120 where flow friction may be relatively small. Thus, the protective grille 100 according to an embodiment may efficiently reduce flow resistance through a relatively simple structure.

Figure 11:
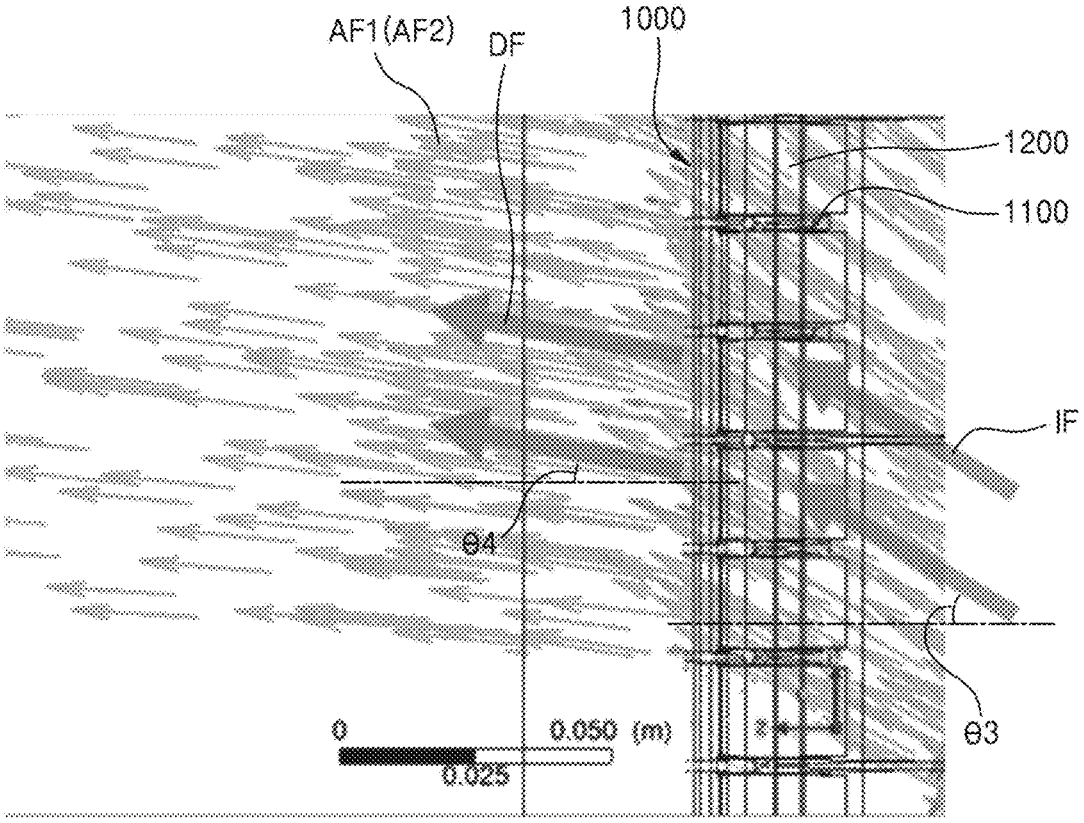
FIG. 11 is a diagram illustrating an air current passing through a protective grille, according to a comparative example.
Figure 12:
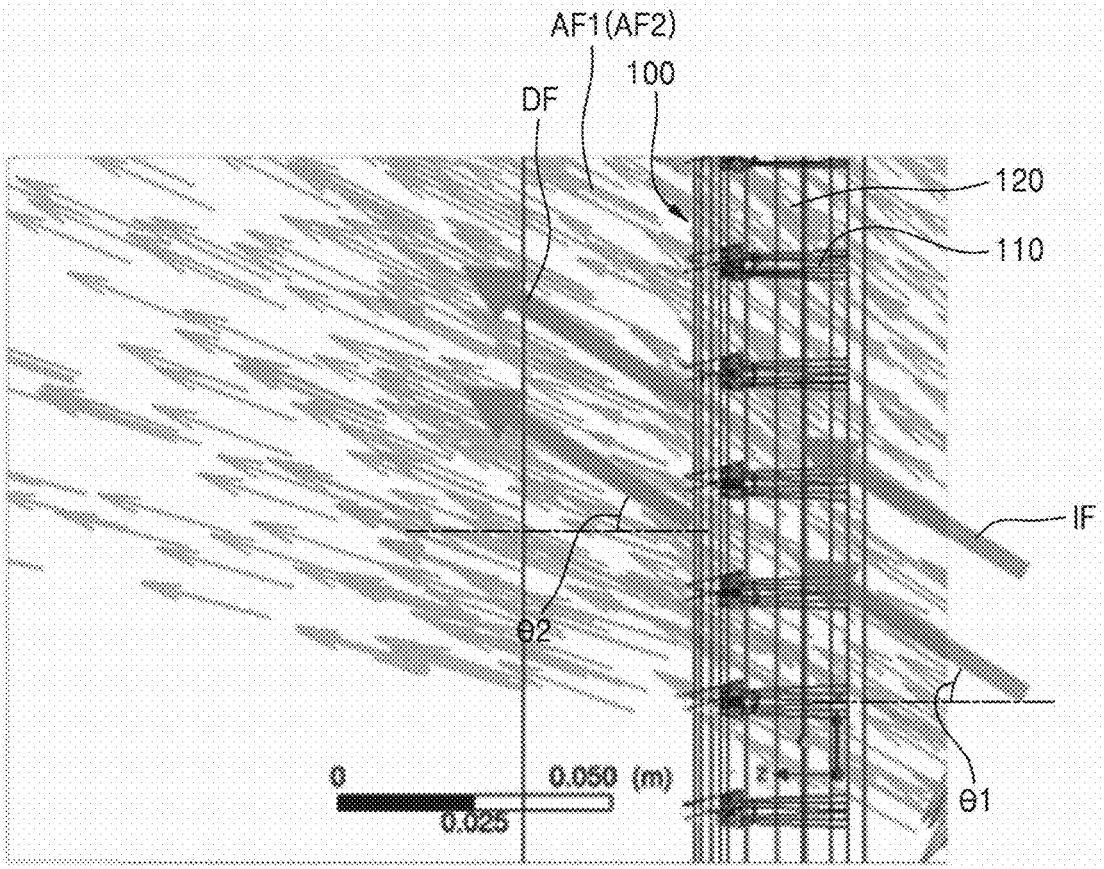
FIG. 12 is a diagram illustrating an air current passing through a protective grille, according to various embodiments.

FIG. 11 is a diagram illustrating air currents AF1 and AF2 passing through a protective grille 1000 according to a comparative example, and FIG. 12 is a diagram illustrating air currents AF1 and AF2 passing through the protective grille 100 according to various embodiments.

Referring to FIG. 11, the protective grille 1000 according to the comparative example includes a plurality of horizontal ribs 1100 parallel to each other without inclination with respect to the first plane XY, and a plurality of vertical ribs 1200 without inclination with respect to the second plane XZ. The air currents AF1 and AF2 generated by the blowing fan 22 pass through the protective grille 1000 according to the comparative example. The air currents AF1 and AF2 move from one end to the other end of the protective grille 1000 in the front-rear direction. That is, the air currents AF1 and AF2 are sucked into one end of the protective grille 1000 and discharged from the other end. Because a suction flow IF of the air currents AF1 and AF2 sucked into one end of the protective grille 1000 is in a direction inclined with respect to the first plane XY, and thus, the directions of the air currents AF1 and AF2 change when they hits the protective grille 1000. Accordingly, an angle θ4 of a discharge flow DF discharged from the other end of the protective grille 1000 with respect to the first plane XY becomes different from an angle θ3 of the suction flow IF introduced into the one end of the protective grille 1000 with respect to the first plane XY.

Referring to FIG. 12, in the protective grille 100 according to an embodiment, the plurality of horizontal ribs 110 have inclinations with respect to the first plane XY, and the plurality of vertical ribs 120 have inclinations with respect to the second plane XZ. Accordingly, even when a suction flow IF of the air currents AF1 and AF2 sucked into one end of the protective grille 100 is in a direction inclined with respect to the first plane XY, the flow resistance hitting the protective grille 100 may be reduced. Accordingly, an angle 62 of a discharge flow DF discharged from the other end of the protective grille 100 with respect to the first plane XY becomes similar to an angle θ1 of the suction flow IF introduced into the one end of the protective grille 100 with respect to the first plane XY. For example, the difference between the angle θ1 of the suction flow IF with respect to the first plane XY and the angle θ2 of the discharge flow DF with respect to the first plane XY may be within 10% of the angle θ1 of the suction flow IF. For example, the difference between the angle θ1 of the suction flow IF with respect to the first plane XY and the angle θ2 of the discharge flow DF with respect to the first plane XY may be within 5% of the angle θ1 of the suction flow IF.

For the purposes of promoting understanding of the present disclosure, reference numerals are used in the various example embodiments illustrated in the drawings, and particular terms are used to describe various embodiments, however, the present disclosure is not limited by the terms and should be construed to encompass all components that would normally occur to those skilled in the art.

Particular executions described herein are merely examples and do not limit the scope of the present disclosure in any way. For the sake of brevity, related-art electronics, control systems, software and other functional aspects of the systems may not be described in detail. Furthermore, line connections or connection members between elements depicted in the drawings represent functional connections and/or physical or circuit connections by way of example, and in actual applications, they may be replaced or embodied with various suitable additional functional connections, physical connections, or circuit connections. In addition, no item or component is essential to the practice of the present disclosure unless the item or component is specifically described as being "essential" or "critical". As used herein, the term such as "comprising", "including" and the like are used to be understood as being an open-ended term for description.

The use of the terms "the" and similar referents in the context of describing the present disclosure (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the disclosure as if it were individually recited herein. Finally, the operations of the methods described herein may be performed in any suitable order unless otherwise indicated herein or otherwise clearly contradicted by context. The present disclosure is not limited to the described order of the operations. The use of any and all examples, or example language (e.g., 'and the like') provided herein, is intended merely to better illuminate the present disclosure and does not pose a limitation on the scope of the present disclosure unless otherwise claimed. Furthermore, various changes and modifications will be readily apparent to one of ordinary skill in the art without departing from the spirit and scope of the present disclosure.

An embodiment provides a blowing apparatus including a protective grille in an orthogonal structure and capable of reducing flow resistance caused by a protective grille, and an air conditioner including the blowing apparatus.

A blowing apparatus according to an example embodiment includes: a blowing fan and a protective grille arranged in front of the blowing fan, wherein the protective grille includes: a plurality of horizontal ribs extending in a first direction and arranged in a second direction perpendicular to the first direction; and a plurality of vertical ribs extending in the second direction and arranged in the first direction to be perpendicular to the plurality of horizontal ribs, based on the blowing fan rotating, an air current moving in a third direction perpendicular to the first direction and the second direction is generated, and to correspond to a direction of rotation of the air current generated by the blowing fan, an inclination angle of each of the plurality of horizontal ribs with respect to a first plane including the first direction and the third direction changes according to a position in the first direction, and an inclination angle of each of the plurality of vertical ribs with respect to a second plane including the second direction and the third direction changes according to a position in the second direction.

The inclination angle of each of the plurality of horizontal ribs may increase from a center to an end in the first direction, and the inclination angle of each of the plurality of vertical ribs may increase from a center to an end in the second direction.

The amount of change in the inclination angle of each of the plurality of horizontal ribs from the center to the end may be 45 degrees or less, and the amount of change in the inclination angle of each of the plurality of vertical ribs from the center to the end may be 45 degrees or less.

When the protective grille is divided into quadrants by virtual axes in the first direction and the second direction with respect to a center of rotation of the blowing fan, combinations of the inclination angles of the plurality of horizontal ribs and the plurality of vertical ribs arranged in the respective quadrant may be different from each other.

In a first quadrant among the quadrants, each of the plurality of horizontal ribs may have a positive inclination angle with respect to the first plane, which is inclined in a downward or upward direction with respect to the first plane, and each of the plurality of vertical ribs may have a positive inclination angle with respect to the second plane, which is inclined in a rightward or leftward direction with respect to the second plane, and in a third quadrant among the quadrants, each of the plurality of horizontal ribs may have a negative inclination angle with respect to the first plane, which is inclined in an upward or downward direction with respect to the first plane, and each of the plurality of vertical ribs may have a negative inclination angle with respect to the second plane, which is inclined in a leftward or rightward direction with respect to the second plane.

When a direction of rotation of the air current is clockwise, the air current may move downward to the right in the first quadrant among the quadrants and upward to the left in the third quadrant, in the first quadrant among the quadrants, each of the plurality of horizontal ribs may have a positive inclination angle with respect to the first plane, which is inclined in a downward direction with respect to the first plane, and each of the plurality of vertical ribs may have a positive inclination angle with respect to the second plane, which is inclined in a rightward direction with respect to the second plane, and in the third quadrant among the quadrants, each of the plurality of horizontal ribs may have a negative inclination angle with respect to the first plane, which is inclined in an upward direction with respect to the first plane, and each of the plurality of vertical ribs may have a negative inclination angle with respect to the second plane, which is inclined in a leftward direction with respect to the second plane.

The plurality of horizontal ribs may have the same shape, and the plurality of vertical ribs may have the same shape.

A spacing between the plurality of horizontal ribs may be smaller than a spacing between the plurality of vertical ribs.

A shape of the protective grille may be different from a shape of the blowing fan.

A thickness of each of the plurality of horizontal ribs and the plurality of vertical ribs may be between 10 mm and 500 mm.

According to an example embodiment, an air conditioner includes: a blowing fan, a protective grille arranged in front of the blowing fan, and a housing accommodating the blowing fan, wherein the protective grille includes: a plurality of horizontal ribs extending in a first direction and arranged in a second direction perpendicular to the first direction; and a plurality of vertical ribs extending in the second direction and arranged in the first direction to be perpendicular to the plurality of horizontal ribs, based on the blowing fan rotating, an air current moving in a third direction perpendicular to the first direction and the second direction is generated, and to correspond to a direction of rotation of the air current generated by the blowing fan, an inclination angle of each of the plurality of horizontal ribs with respect to a first plane including the first direction and the third direction changes according to a position in the first direction, and an inclination angle of each of the plurality of vertical ribs with respect to a second plane including the second direction and the third direction changes according to a position in the second direction.

The inclination angle of each of the plurality of horizontal ribs may increase from a center to an end in the first direction, and the inclination angle of each of the plurality of vertical ribs may increase from a center to an end in the second direction.

The amount of change in the inclination angle of each of the plurality of horizontal ribs from the center to the end may be 45 degrees or less, and the amount of change in the inclination angle of each of the plurality of vertical ribs from the center to the end may be 45 degrees or less.

When the protective grille is divided into quadrants by virtual axes in the first direction and the second direction with respect to a center of rotation of the blowing fan, combinations of the inclination angles of the plurality of horizontal ribs and the plurality of vertical ribs arranged in the respective quadrant may be different from each other.

In a first quadrant among the quadrants, each of the plurality of horizontal ribs may have a positive inclination angle with respect to the first plane, which is inclined in a downward or upward direction with respect to the first plane, and each of the plurality of vertical ribs may have a positive inclination angle with respect to the second plane, which is inclined in a rightward or leftward direction with respect to the second plane, and in a third quadrant among the quadrants, each of the plurality of horizontal ribs may have a negative inclination angle with respect to the first plane, which is inclined in an upward or downward direction with respect to the first plane, and each of the plurality of vertical ribs may have a negative inclination angle with respect to the second plane, which is inclined in a leftward or rightward direction with respect to the second plane.

The blowing apparatus and the air conditioner according to the above-described embodiments include a protective grille in an orthogonal structure to provide aesthetics of an outdoor unit while reducing noise and power consumption of the outdoor unit through a structure that reduces flow resistance caused by the protective grille.

While the disclosure has been illustrated and described with reference to various example embodiments, it will be understood that the various example embodiments are intended to be illustrative, not limiting. It will be further understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

What is claimed is:

1. A blowing apparatus comprising a blowing fan and a protective grille arranged in front of the blowing fan, wherein the protective grille comprises:

a plurality of horizontal ribs extending in a first direction and arranged in a second direction perpendicular to the first direction; and a plurality of vertical ribs extending in the second direction and arranged in the first direction to be perpendicular to the plurality of horizontal ribs, wherein the plurality of horizontal ribs and the plurality of vertical ribs are arranged orthogonally and perpendicularly to each other to define rectangular openings, the ribs being straight in plan view and non-radial with respect to a center of rotation of the blowing fan;

based on the blowing fan rotating, an air current moving in a third direction perpendicular to the first direction and the second direction is generated, and an inclination angle of each of the plurality of horizontal ribs with respect to a first plane comprising the first direction and the third direction is configured to change according to a position in the first direction to correspond to a direction of rotation of the air current generated by the blowing fan, and an inclination angle of each of the plurality of vertical ribs with respect to a second plane comprising the second direction and the third direction is configured to change according to a position in the second direction, wherein the inclination angle of each horizontal rib varies continuously as a function of position in the first direction to correspond to a locally varying direction of the air current generated by the blowing fan, and the inclination angle of each vertical rib varies continuously as a function of position in the second direction to correspond to a locally varying direction of the air current, and wherein the inclination angle of each horizontal rib is approximately zero at a center area overlapping the center of rotation of the blowing fan and increases in magnitude from the center toward opposite ends in the first direction, and wherein the inclination angle of each vertical rib is approximately zero at a center area overlapping the center of rotation of the blowing fan and increases in magnitude from the center toward opposite ends in the second direction.

2. The blowing apparatus of claim 1, wherein an amount of change in the inclination angle of each of the plurality of horizontal ribs from the center to the end is 45 degrees or less, and an amount of change in the inclination angle of each of the plurality of vertical ribs from the center to the end is 45 degrees or less.

3. The blowing apparatus of claim 1, wherein, based on the protective grille being divided into quadrants by virtual axes in the first direction and the second direction with respect to a center of rotation of the blowing fan, combinations of the inclination angles of the plurality of horizontal ribs and the plurality of vertical ribs arranged in the respective quadrant are different from each other.

4. The blowing apparatus of claim 3, wherein, in a first quadrant among the quadrants, each of the plurality of horizontal ribs has a positive inclination angle with respect to the first plane, inclined in a downward or upward direction with respect to the first plane, and each of the plurality of vertical ribs has a positive angle with respect to the second plane, inclined in a rightward or leftward direction with respect to the second plane, and in a third quadrant among the quadrants, each of the plurality of horizontal ribs has a negative inclination angle with respect to the first plane, inclined in an upward or downward direction with respect to the first plane, and each of the plurality of vertical ribs has a negative inclination angle with respect to the second plane, inclined in a leftward or rightward direction with respect to the second plane.

5. The blowing apparatus of claim 4, wherein, based on a direction of rotation of the air current being clockwise, the air current moves downward to the right in the first quadrant among the quadrants and upward to the left in the third quadrant, in the first quadrant among the quadrants, each of the plurality of horizontal ribs has a positive inclination angle with respect to the first plane, inclined in a downward direction with respect to the first plane, and each of the plurality of vertical ribs has a positive inclination angle with respect to the second plane, inclined in a rightward direction with respect to the second plane, and in the third quadrant among the quadrants, each of the plurality of horizontal ribs has a negative inclination angle with respect to the first plane, inclined in an upward direction with respect to the first plane, and each of the plurality of vertical ribs has a negative inclination angle with respect to the second plane, inclined in a leftward direction with respect to the second plane.

6. The blowing apparatus of claim 5, wherein the plurality of horizontal ribs have the same shape, and the plurality of vertical ribs have the same shape.

7. The blowing apparatus of claim 1, wherein a spacing between the plurality of horizontal ribs is less than a spacing between the plurality of vertical ribs.

8. The blowing apparatus of claim 1, wherein a shape of the protective grille is different from a shape of the blowing fan.

9. The blowing apparatus of claim 1, wherein a thickness of each of the plurality of horizontal ribs and the plurality of vertical ribs is between 10 mm and 500 mm.

10. An air conditioner comprising a blowing fan, a protective grille arranged in front of the blowing fan, and a housing accommodating the blowing fan, wherein the protective grille comprises:

a plurality of horizontal ribs extending in a first direction and arranged in a second direction perpendicular to the first direction; and a plurality of vertical ribs extending in the second direction and arranged in the first direction to be perpendicular to the plurality of horizontal ribs, wherein the plurality of horizontal ribs and the plurality of vertical ribs are arranged orthogonally and perpendicularly to each other to define rectangular openings, the ribs being straight in plan view and non-radial with respect to a center of rotation of the blowing fan, based on the blowing fan rotating, an air current moving in a third direction perpendicular to the first direction and the second direction is generated, and an inclination angle of each of the plurality of horizontal ribs with respect to a first plane comprising the first direction and the third direction is configured to change according to a position in the first direction to correspond to a direction of rotation of the air current generated by the blowing fan, and an inclination angle of each of the plurality of vertical ribs with respect to a second plane comprising the second direction and the third direction changes according to a position in the second direction, wherein the inclination angle of each horizontal rib varies continuously as a function of position in the first direction to correspond to a locally varying direction of the air current generated by the blowing fan, and the inclination angle of each vertical rib varies continuously as a function of position in the second direction to correspond to a locally varying direction of the air current, and wherein the inclination angle of each horizontal rib is approximately zero at a center area overlapping the center of rotation of the blowing fan and increases in magnitude from the center toward opposite ends in the first direction, and wherein the inclination angle of each vertical rib is approximately zero at a center area overlapping the center of rotation of the blowing fan and increases in magnitude from the center toward opposite ends in the second direction.

11. The air conditioner of claim 10, wherein an amount of change in the inclination angle of each of the plurality of horizontal ribs from the center to the end is 45 degrees or less, and an amount of change in the inclination angle of each of the plurality of vertical ribs from the center to the end is 45 degrees or less.

12. The air conditioner of claim 10, wherein, based on the protective grille being divided into quadrants by virtual axes in the first direction and the second direction with respect to a center of rotation of the blowing fan, combinations of the inclination angles of the plurality of horizontal ribs and the plurality of vertical ribs arranged in the respective quadrant are different from each other.

13. The air conditioner of claim 12, wherein, in a first quadrant among the quadrants, each of the plurality of horizontal ribs has a positive inclination angle with respect to the first plane, inclined in a downward or upward direction with respect to the first plane, and each of the plurality of vertical ribs has a positive inclination angle with respect to the second plane, inclined in a rightward or leftward direction with respect to the second plane, and in a third quadrant among the quadrants, each of the plurality of horizontal ribs has a negative inclination angle with respect to the first plane, inclined in an upward or downward direction with respect to the first plane, and each of the plurality of vertical ribs has a negative inclination angle with respect to the second plane, inclined in a leftward or rightward direction with respect to the second plane.

* * * * *